US009149111B1

(12) United States Patent
Lin

(10) Patent No.: US 9,149,111 B1
(45) Date of Patent: Oct. 6, 2015

(54) COLLAPSIBLE TRAY TABLE

(71) Applicant: Zhuhai Shichang Metals Ltd., Zhuahi (CN)

(72) Inventor: Wen-Sheng Lin, Kaohsiung (TW)

(73) Assignee: Zhuhai Shichang Metals Ltd. (CN)

( * ) Notice: Subject to any disclaimer, the term of this patent is extended or adjusted under 35 U.S.C. 154(b) by 0 days.

(21) Appl. No.: 14/509,255

(22) Filed: Oct. 8, 2014

Related U.S. Application Data

(63) Continuation-in-part of application No. 29/492,043, filed on May 28, 2014.

(51) Int. Cl.

| | |
|---|---|
| ***A47F 5/12*** | (2006.01) |
| ***A47B 3/08*** | (2006.01) |
| ***A47B 9/00*** | (2006.01) |
| ***A47B 13/02*** | (2006.01) |

(52) U.S. Cl.
CPC ..... *A47B 3/0812* (2013.01); *A47B 9/00* (2013.01); *A47B 13/02* (2013.01)

(58) Field of Classification Search
CPC ..... A47B 3/00; A47B 3/08; A47B 3/091; A47B 3/0916; A47B 3/0915; A47B 27/18
USPC ..... 108/132, 10, 9, 115, 146, 147.21, 6; 248/161, 133
See application file for complete search history.

(56) References Cited

U.S. PATENT DOCUMENTS

| | | | | |
|---|---|---|---|---|
| 861,810 | A * | 7/1907 | Coblentz | 108/115 |
| 879,620 | A * | 2/1908 | Forsyth | 108/10 |
| 962,922 | A * | 6/1910 | Schryver | 108/10 |
| 1,402,929 | A | 1/1922 | Herpst et al. | |
| 1,443,998 | A * | 2/1923 | Meltzer | 108/10 |
| 1,485,244 | A * | 2/1924 | Borger | 108/10 |
| 1,564,359 | A * | 12/1925 | Klein | 108/6 |
| 2,293,144 | A * | 8/1942 | Jones | 248/408 |
| 2,619,395 | A | 11/1952 | Kent | |

(Continued)

FOREIGN PATENT DOCUMENTS

| | | |
|---|---|---|
| GB | 149112 | 8/1920 |

OTHER PUBLICATIONS

Lee Valley & Veritas; 4-Position Folding Brackets—Lee Valley Tools; Copyright 1998 to 2014 Lee Valley Tools Ltd. and Veritas Tools Inc.; http://www.leevalley.com/en/hardware/page.aspx?p=470037&cat=3,43648,43651; Apr. 29, 2014.

(Continued)

*Primary Examiner* — Jose V Chen
(74) *Attorney, Agent, or Firm* — Luedeka Neely Group, P.C.

(57) ABSTRACT

An adjustable tray table having a tabletop, a tabletop support connected to the tabletop, and a base assembly attached to the tabletop support and configured to allow the tabletop to move from a substantially vertical orientation to a substantially horizontal orientation. The base support includes a spring-biased squeezable latch, which has a squeezed position and a released position. The latch is configured to engage an engagement opening in the tabletop support, which fixes the tabletop support in a desired orientation corresponding to the engagement opening. The latch is also configured to disengage from the engagement opening and to slide along a slot in the tabletop support until it reaches a different engagement opening corresponding to a different orientation.

11 Claims, 10 Drawing Sheets

(56) References Cited

U.S. PATENT DOCUMENTS

| | | | | |
|---|---|---|---|---|
| 3,437,058 | A * | 4/1969 | Bue | 108/166 |
| 3,525,492 | A * | 8/1970 | Kaufman et al. | 248/188.6 |
| 3,908,561 | A * | 9/1975 | Cowley | 108/6 |
| 4,113,221 | A * | 9/1978 | Wehner | 248/408 |
| 4,248,161 | A * | 2/1981 | Adair et al. | 108/6 |
| 4,669,694 | A | 6/1987 | Malick | |
| 5,381,738 | A | 1/1995 | Meyer | |
| D363,051 | S | 10/1995 | Lanzillo | |
| 5,671,091 | A * | 9/1997 | Monroe et al. | 108/10 |
| 5,775,655 | A | 7/1998 | Schmeets | |
| 6,192,808 | B1 | 2/2001 | Bue | |
| 6,354,227 | B1 * | 3/2002 | Feldpausch et al. | 108/10 |
| 6,694,891 | B1 * | 2/2004 | Lai | 108/6 |
| 7,069,865 | B2 * | 7/2006 | Strong et al. | 108/132 |
| D548,496 | S | 8/2007 | Samtani | |
| D552,382 | S | 10/2007 | Theemann | |
| 7,322,912 | B2 | 1/2008 | Hockemeyer | |
| 7,614,351 | B2 * | 11/2009 | Piretti | 108/115 |
| 7,631,604 | B2 * | 12/2009 | Huang | 108/116 |
| 7,712,422 | B2 * | 5/2010 | Bue | 108/115 |
| D626,238 | S | 10/2010 | Zinnanti | |
| 8,051,785 | B2 | 11/2011 | Lin | |
| 8,584,601 | B1 | 11/2013 | Deschner | |
| 8,789,474 | B2 * | 7/2014 | Kim et al. | 108/10 |
| 8,960,104 | B2 * | 2/2015 | Copeland et al. | 108/117 |
| 2007/0234934 | A1 * | 10/2007 | Branch et al. | 108/115 |
| 2009/0241805 | A1 * | 10/2009 | Hernandez | 108/6 |

OTHER PUBLICATIONS

KV 206 Series Folding L-Brackets; Knape & Vogt (R), 2007 Oak Industrial Drive NE, Grand Rapids, MI USA 49505; www.kv.com; 2009.

Functional Folding Shelf Bracket with One Hand. Table Top Shelf Folding 3 Sizes; http://www.ebay.com; Apr. 29, 2014.

Hafele Connectors and Shelf Supports/ dimensions in mm inches are approximate 117H; www.hafele.com.

Polished Stainless Steel Folding Shelf Bench Table Folding Shelf or Bracket; http://www.ebay.com/itm/Polished-Stainless-Steel-Folding-Shelf-Bench-Table-Folding-Shelf-or-Bracket-/190864233552; Apr. 29, 2014.

* cited by examiner

COLLAPSIBLE TRAY TABLE

FIELD

This invention relates to the field of tray tables. More particularly, this invention relates to a tray table having a squeezable latch that enables the table to collapse from a horizontal position to a vertical position.

BACKGROUND

Tray tables are useful due to their small size and portability. Additionally, they have a wide variety of uses, including, for example, as a table for computer monitors, as a reading desk, as a dinner table, etc. One problem encountered by users of tray tables is that they may are sometimes not readily storable and also the angle of the tabletop is often fixed. What is needed, therefore, is tray table that facilitates easy storage and in which the tabletop may be easily and quickly changed according to a user's particular needs.

SUMMARY

The above and other needs are met by an adjustable tray table having a tabletop, a tabletop support mounted to the tabletop, and a base assembly mounted to the tabletop support. The base assembly is configured to allow the tabletop to move from a substantially vertical orientation to a substantially horizontal orientation.

In a preferred embodiment, the tabletop support includes parallel first and second outer support members spaced apart from one another and attached to the bottom surface of the tabletop, and parallel first and second inner support members spaced apart from one another and disposed between and orthogonal to the first and second outer support members. Preferably, the inner support members are orthogonal to the outer support members in an H-shape. Each of the first and second inner support members include a pivot connection and a slotted connection. This slotted connection includes a slot and a plurality of circular engagement openings that are spaced-apart along the slot. Each engagement opening has an inner diameter that is larger than the slot width.

The base assembly preferably includes an upright member having a lower portion supported above a floor surface and an upper portion pivotally connected to the pivot connections of the tabletop support. The base assembly also includes an arm having a first end and a second end. The first end of the arm is pivotally connected to the upper portion of the upright member. The base assembly includes a latch assembly that is connected to the second end of the arm.

The latch assembly preferably includes a latch cylinder that is located between the first and second inner support members and is configured to slide along the slotted connections.

In the preferred embodiment, first and second receivers are located within the latch cylinder adjacent the first and second inner support members. The first receiver includes a first cylindrical extension portion having an outer diameter that is smaller than the inner diameter of the engagement openings, but larger than the slot width of the slotted connection. The first cylindrical extension also has an outward-facing threaded opening and an inward-facing opening opposite from the first cylindrical extension.

The second receiver preferably includes a second cylindrical extension portion having an outer diameter that is smaller than the inner diameter of the engagement openings, but larger than the slot width in the slotted connection of the second inner support member. The second cylindrical extension also has an outward-facing threaded opening and an elongate post extending inwards in a direction opposite from the second cylindrical extension.

In the preferred embodiment, the helical spring is also located within the latch cylinder and is placed around the elongate post. The helical spring has a first end pressing against the first receiver and a second end pressing against the second receiver. In this configuration, the helical spring urges the first and second receivers in an outward direction away from the latch cylinder and toward the first and second inner support members.

The latch assembly also preferably includes a first engagement member connected to the first receiver and a second engagement member connected to the second receiver. The first engagement member includes a first shaft passing through the slot of the slotted connection of the first inner support member. The first shaft has threads that engage the outward-facing threaded opening of the first cylindrical extension portion of the first receiver in order to connect the first engagement member to the first receiver. The first shaft has an outer diameter that is less than the slot width of the slotted connection so that it may slide freely within the slot. A first button portion is connected to the first shaft and is outside the first inner support member. The first button portion is larger than the engagement openings of the slotted connection of the first inner support member so that it is precluded from passing through the engagement openings.

Similarly, the second engagement member includes a second shaft passing through the slot of the slotted connection of the second inner support member. The second shaft has threads that engage the outward-facing threaded opening of the second cylindrical extension portion of the second receiver in order to connect the second engagement member to the second receiver. The second shaft has an outer diameter that is less than the slot width of the slotted connection so that it may slide freely within the slot. A second button portion is connected to the second shaft and is outside the second inner support member. The second button portion is larger than the engagement openings of the slotted connection of the second inner support member so that it is precluded from passing through the engagement openings.

When an external squeezing force is applied to the first and second button portions of the first and second engagement members to urge the first and second receivers inwardly toward each other, the first and second cylindrical extension portions of the first and second receivers slide inwardly and disengage from the engagement openings of the slotted connections of the first and second inner support members. This action allows the first and second shafts of the first and second engagement members to slide freely within the slots of the slotted connections, thereby allowing the latch assembly to move with respect to the first and second inner support members to change the orientation of the tabletop with respect to the base assembly.

When the external squeezing force is removed from the first and second button portions of the first and second engagement members, thereby allowing the helical spring to urge the first and second receivers outwardly away each other, the first and second cylindrical extension portions of the first and second receivers slide outwardly and are received into the engagement openings of the slotted connections of the first and second inner support members. This action locks the latch assembly in place with respect to the first and second inner support members and fixes the orientation of the tabletop with respect to the base assembly.

BRIEF DESCRIPTION OF THE DRAWINGS

Further advantages of various embodiments are apparent by reference to the detailed description when considered in conjunction with the figures, which are not to scale so as to more clearly show the details, wherein like reference numbers indicate like elements throughout the several views, and wherein.

DETAILED DESCRIPTION

Figure 14:
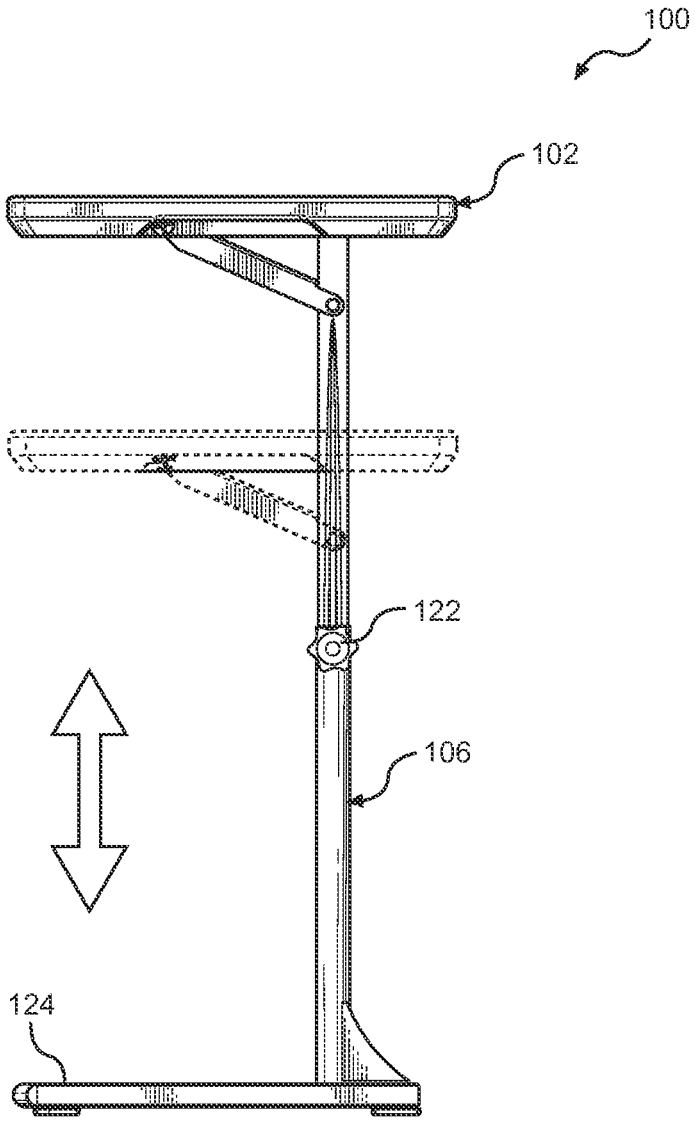
FIG. 14 is a side view of the collapsible tray table shown in FIG. 1 showing the tabletop in raised and lowered positions.

Referring now to the drawings, in which like reference characters designate like or corresponding parts throughout the several views, there is shown in FIGS. 1-9B, a collapsible tray table 100 according to an embodiment of the present invention. In general, the collapsible tray table 100 includes a tabletop 102, an H-shaped tabletop support 104, and a base member 106 that is mounted to the tabletop support. The tabletop 102 may be molded from plastic by injection molding, blow molding or other techniques that are known in the art. The tabletop 102 is fixedly mounted to the tabletop support 104. As shown in FIGS. 10-13, the tabletop 102 can pivot forwards and backwards from a substantially horizontal position for use to a substantially vertical position for storage. It may be desired to also position the tabletop 102 in a position that is between horizontal and vertical. For that reason, the tabletop 102 may be secured in one or more intermediate positions. Additionally, as shown in FIG. 14, the base member 106 may be configured to raise and lower the tabletop 102 to various vertical heights.

Figure 15:
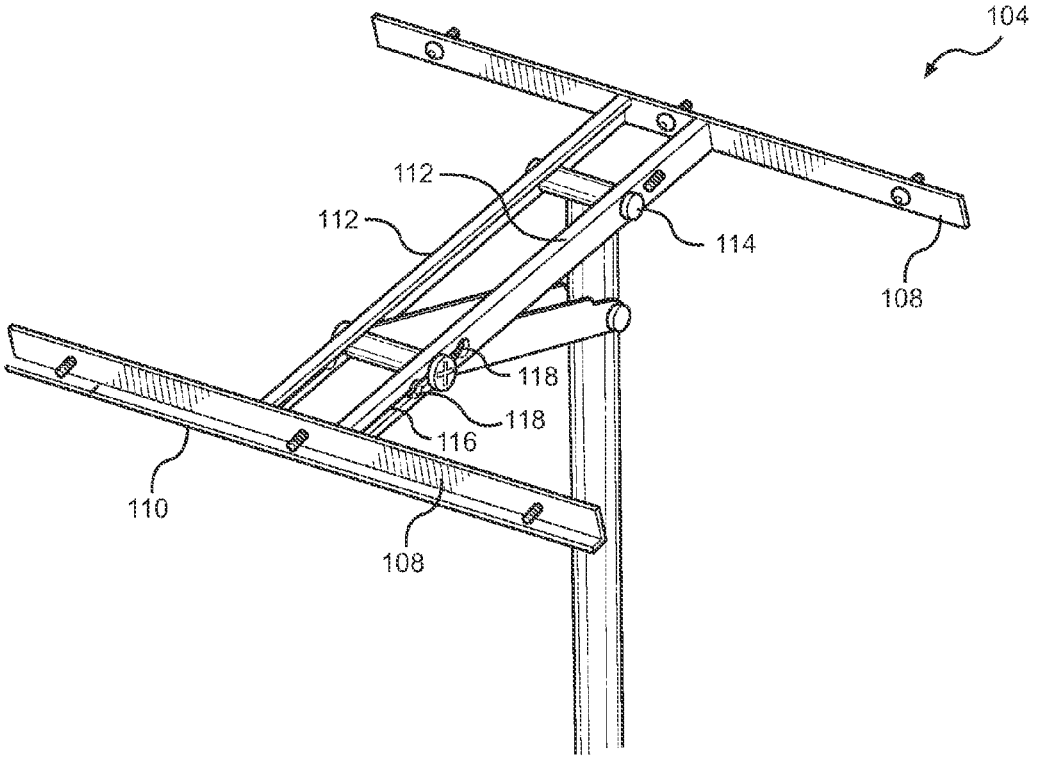
FIG. 15 is a top perspective view of a base member connected to a tabletop support according to an embodiment of the present invention.

As shown in FIG. 15, the tabletop support 104 includes a pair of parallel outer support members 108 that are spaced apart from one another. The outer supports 108 may be fixedly mounted to the bottom surface of the tabletop 102 using a number of fasteners. In certain embodiments, the outer support members 108 may include a support lip 110 that is configured to provide further support to the bottom surface of the tabletop 102. The tabletop support 104 also includes a pair of parallel inner support members 112 that are spaced apart from one another. The inner support members 112 are fixedly mounted between the outer support members 108. The inner support member 112 may be oriented orthogonally to the outer support member 108. The tabletop 104 has a pivot connection 114 and a slotted connection 116 having one or more engagement openings 118 along its length. The engagement openings 118 are slightly larger in diameter than the width of the slot portion of the slotted connection 116. As discussed in greater detail below, the pivot and slotted connections 114, 116 enable the tabletop to collapse from a horizontal orientation to a vertical orientation.

Figure 1:
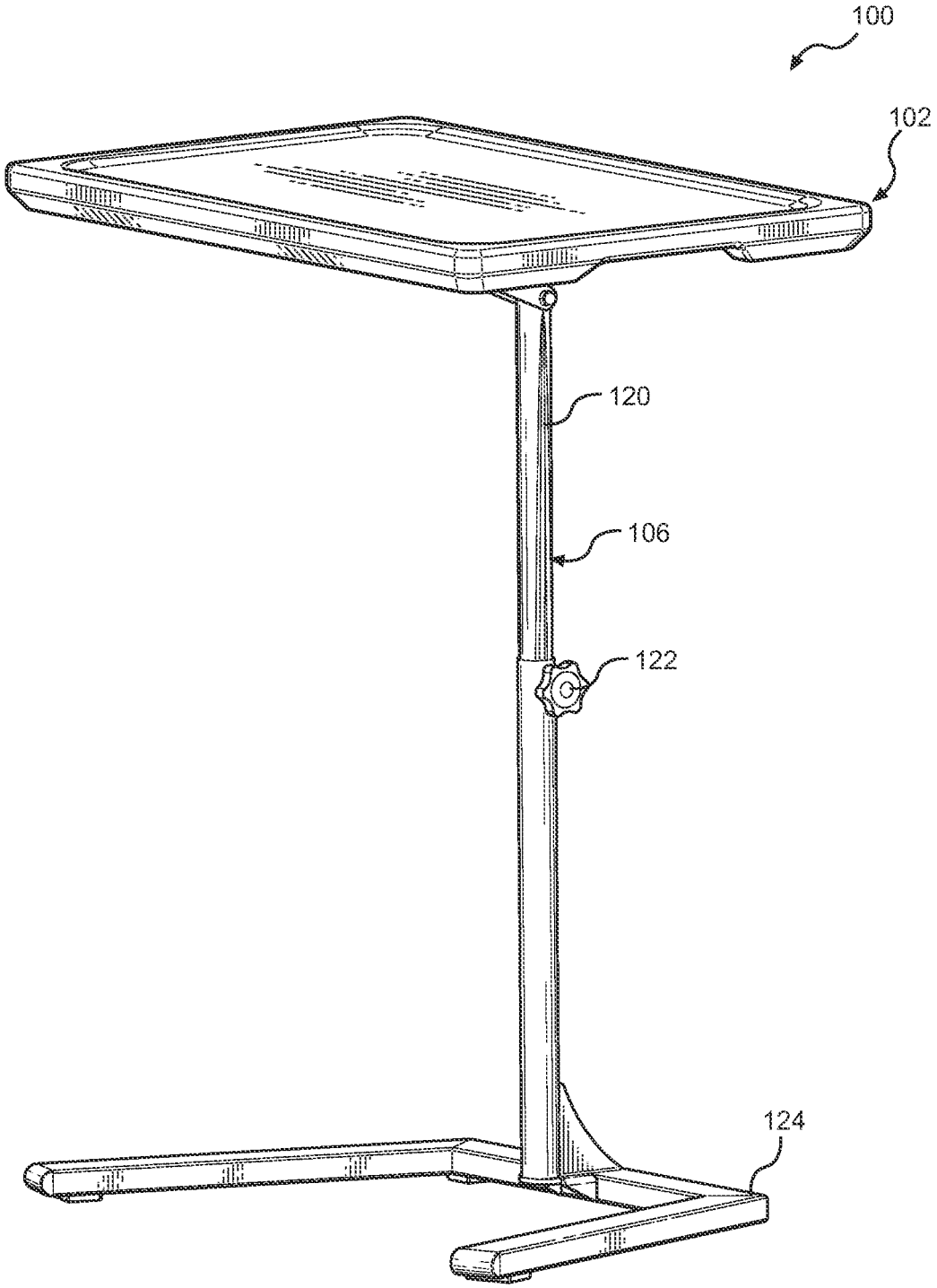
FIG. 1 is a top perspective view of a collapsible tray table according to an embodiment of the present invention.
Figure 3:
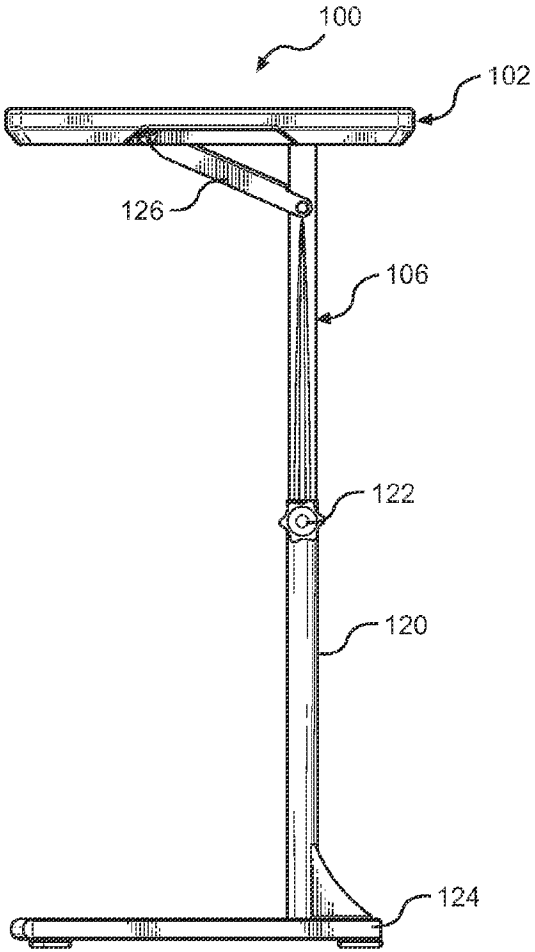
FIGS. 2 and 3 are left and right side views of the collapsible tray table shown in FIG. 1.
Figure 2:
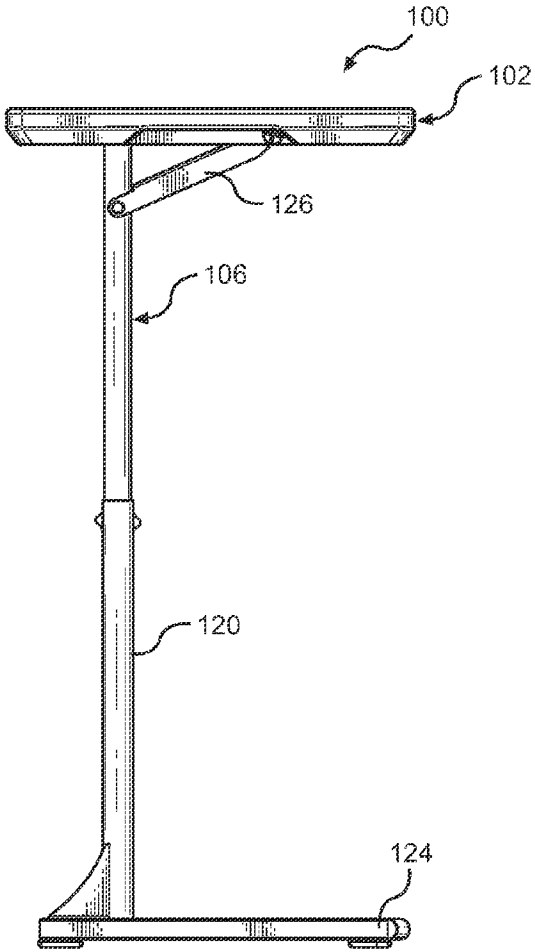
Figure 5:
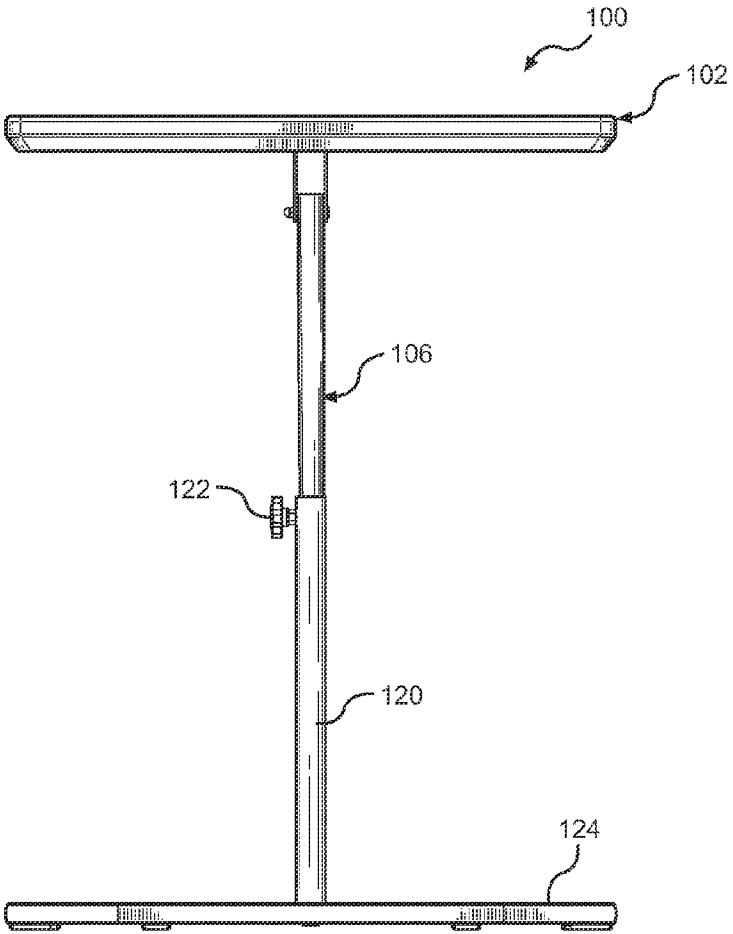
FIGS. 4 and 5 are front and back views of the collapsible tray table shown in FIG. 1.
Figure 4:
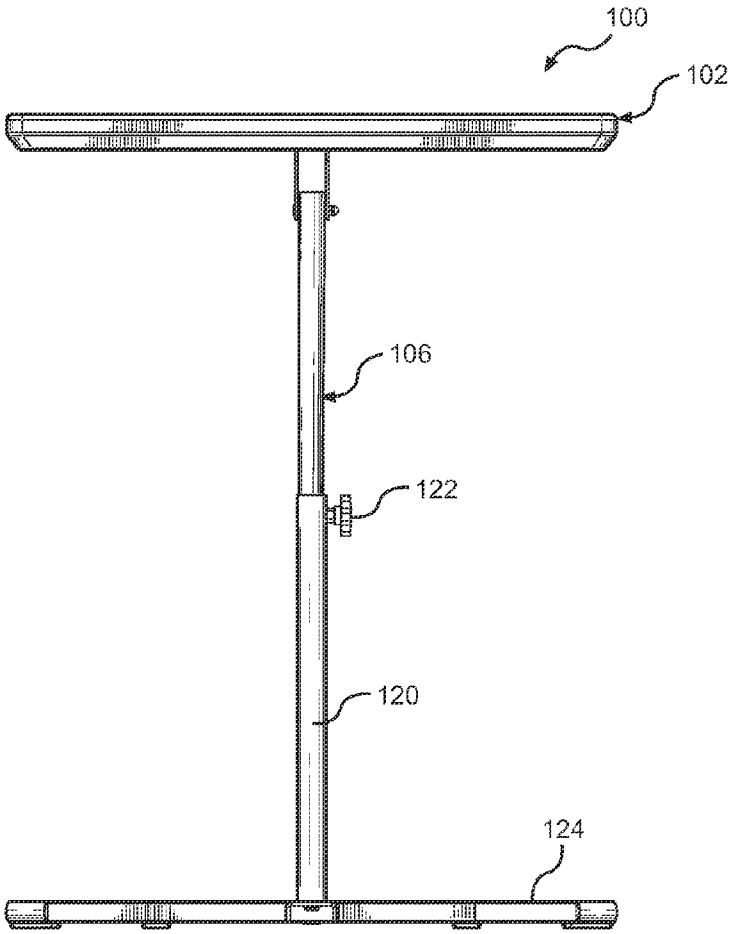
Figure 6:
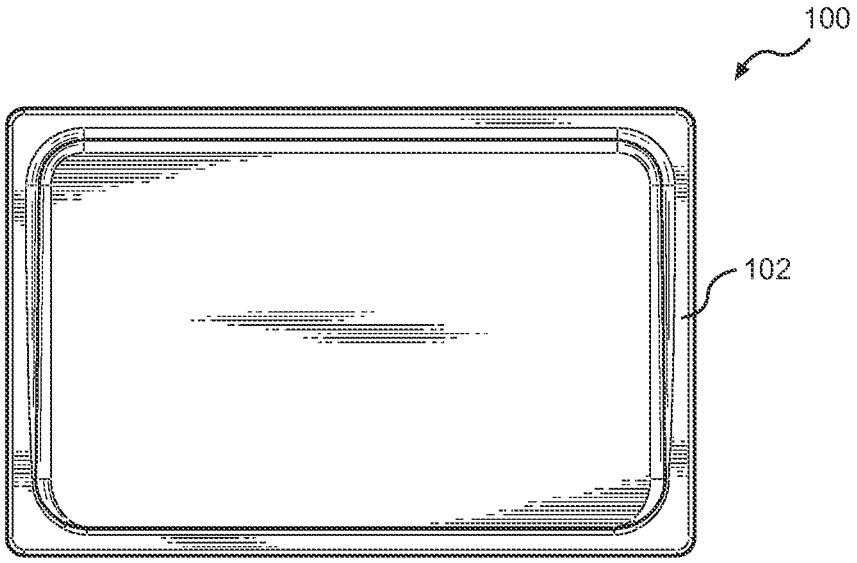
FIGS. 6 and 7 are top and bottom views of the collapsible tray table shown in FIG. 1.
Figure 7:
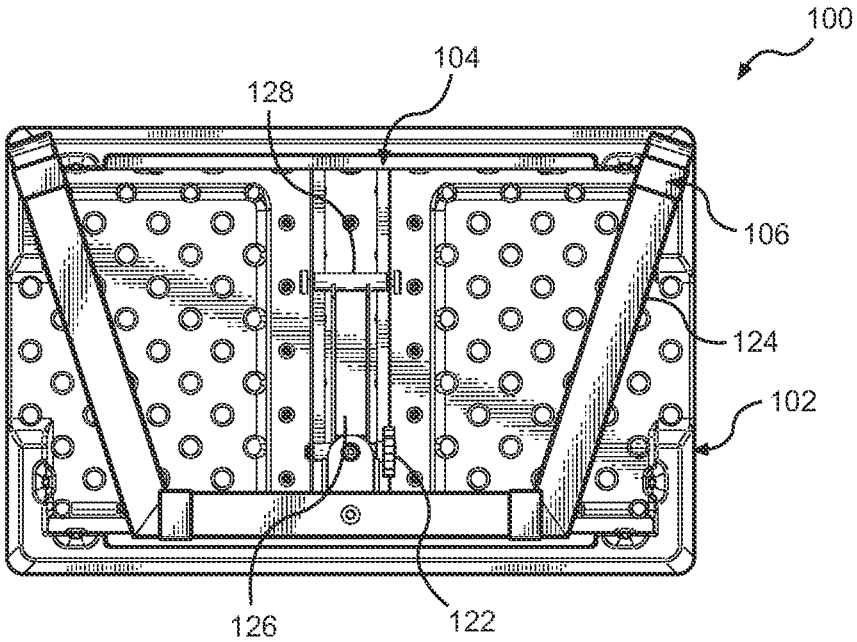
Figure 8:
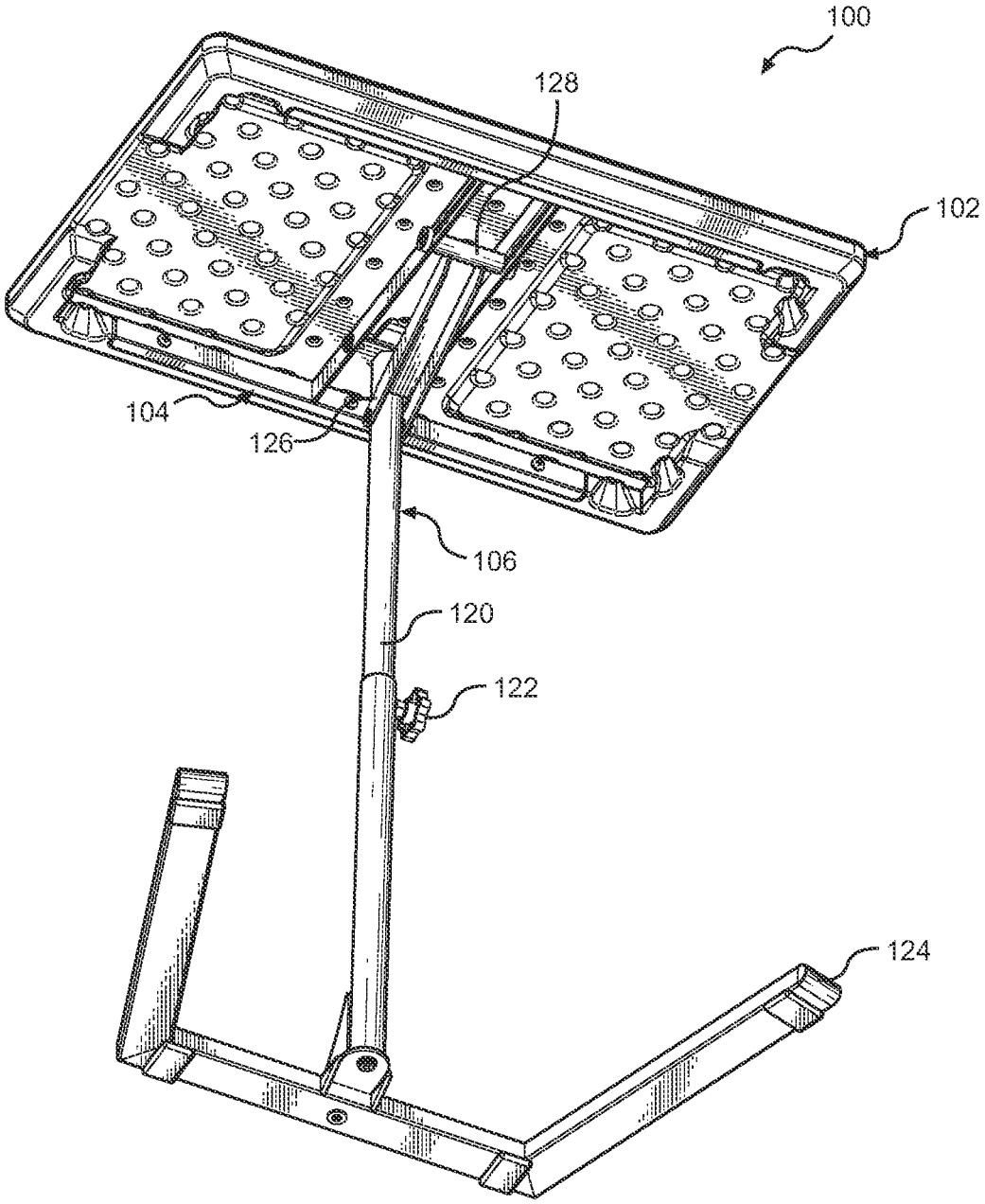
FIG. 8 is a bottom perspective view of the collapsible tray table shown in FIG. 1.
Figure 9A:
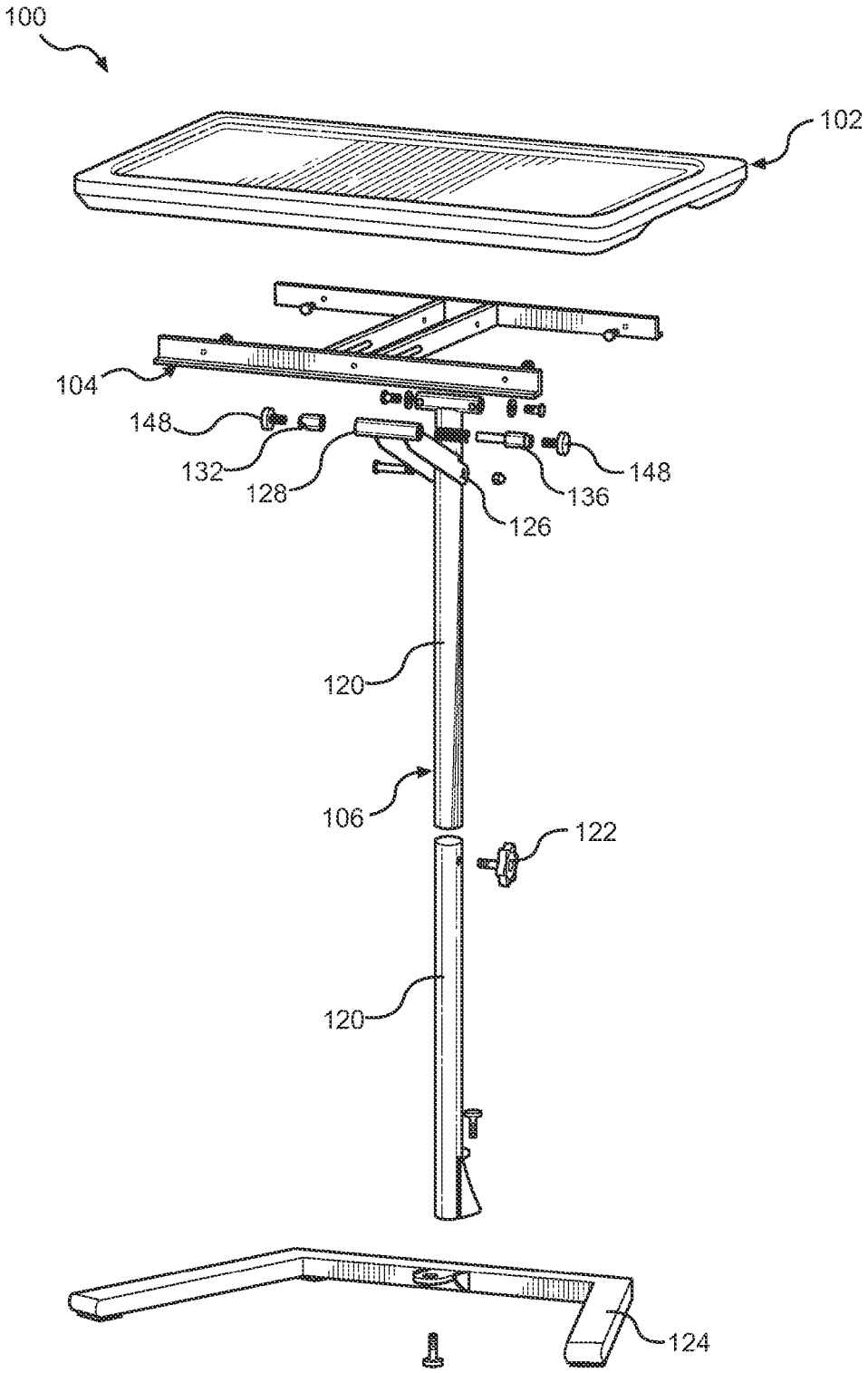
FIGS. 9A and 9B are exploded views of the collapsible tray table shown in FIG. 1.
Figure 9B:
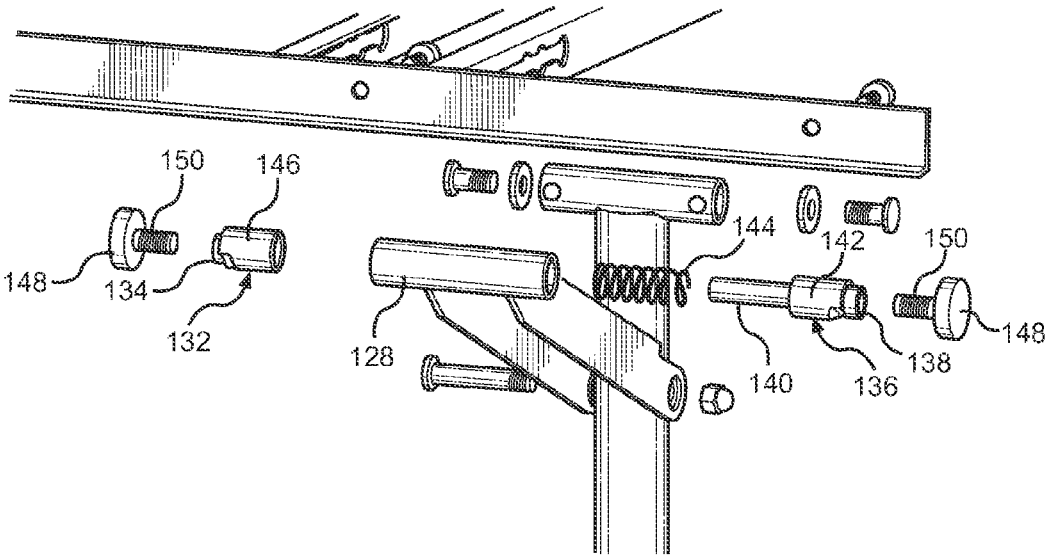
Figure 10:
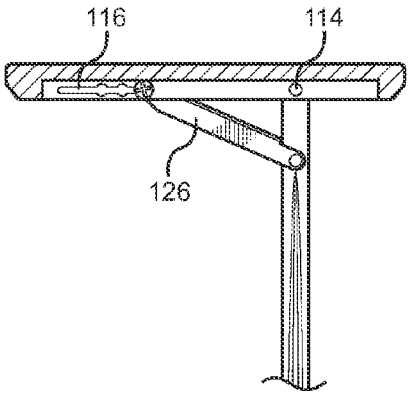
FIGS. 10-13 are side views of a collapsible tray table according to an embodiment of the present invention showing the tabletop in various orientations.
Figure 11:
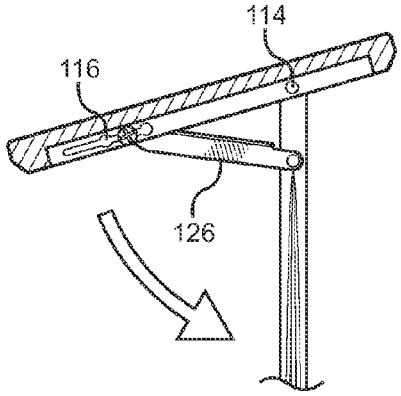
Figure 12:
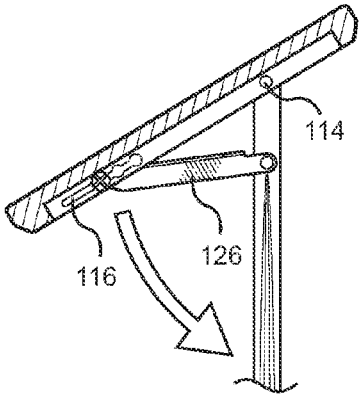
Figure 13:
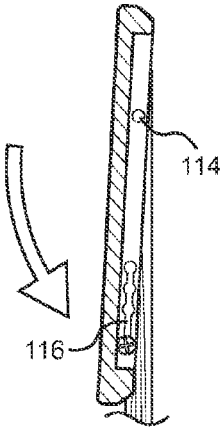

With reference to FIGS. 9A, 9B, and 15, the tabletop support 104 is mounted to the base member or base assembly 106 in at least two locations. The base member 106 generally includes an upright member 120 having a lower portion configured to be supported above a floor surface and an upper portion configured to mount to the tabletop support 104. In certain embodiments, the upright member 120 may include two or more telescopic sections to enable the tabletop 102 to be raised or lowered. For example, the upper portion of the upright member 120 may be telescopically engaged with the lower portion of the upright member. A setscrew 122 may be provided in the lower portion of the upright member 120 to engage the upper portion of the upright member to lock the upright member at a selected height. Additionally, a foot member 124 may be attached to the bottom portion of the upright member 120 to provide a stable base of support.

The upper portion of the upright member 120 is sized for insertion between the inner support members 112 and for pivoting attachment at the pivot connection 114. In this particular embodiment, a pair of threaded connectors are inserted through the outward facing surfaces of the inner support members 112 and then into threaded openings in the upper portion of the upright member 120. The table 100 also includes an arm 126 having a first end that is pivotally mounted to the upper portion of the upright member 120 and a second end that is slidably mounted to the tabletop support 104. As the tabletop 102 moves between the horizontal and vertical orientations, the arm 126 pivots at the first end and slides along the slotted connection 116 at the second end.

As shown in FIGS. 9A and 9B, the first end of the arm 126 includes a pair of spaced apart extensions. A threaded connector is inserted through one extension then through an opening in the upper portion of the upright member 120 and then out through the second extension. The threaded connector allows the arm 126 to pivot at the first end with respect to the upright member 120. A spring-loaded squeezable latch 125 is disposed at the second end of the arm. The latch 125 includes a latch cylinder 128 having two open ends. The latch cylinder 128 is sized so that it slides easily between the inner support members 112. The purpose of the squeezable latch 125 is to selectively fix the arm 126 at selected locations within the slotted connection 116 in order to secure the tabletop 102 at selected orientations. In a preferred embodiment described herein, the latch 125 automatically engages the slotted connection 116 at each selected engagement opening 118. The spring-loaded latch 125 disengages or bypasses the engagement openings 118 when it is squeezed by a user.

The latch 125 includes a first receiver 132 having a threaded outer extension 134 and a second receiver 136 having a threaded outer extension 138. The threaded outer extensions 134, 138 are larger than the narrow slot portion of the slotted connection 116. This prevents the outer extensions 134, 138 from extending out of the slot portion of the slotted connection 116. On the other hand, the outer extensions 134, 138 are smaller than and are sized to be received in the engagement openings 118.

The second receiver 136 has an elongate post 140 that extends inwards. There is a small lip 142 located at an end of the post 140. A helical spring 144 slides over the post 140 and is held in place by the lip 142. The outside diameter of the helical spring 144 is sized to fit inside of the latch cylinder 128. The first receiver 132 includes an opening 146 that is sized to receive the post 140. When the helical spring 144 slides over the post 140 and the first and second receivers 132, 136 are squeezed together, the post is inserted into the opening 146.

This combination of components is configured for placement into the cylindrical latch cylinder 128 between the inner support members 112 and is sized such that the outer extensions 134, 138 would travel along the slotted portion of the connection 116 and then extend out through the engagement openings 118 to lock the latch 125 in place. Once those components are inserted into the cylindrical latch cylinder 128, engagement members 148 having threaded shafts 150 are inserted through the slot of the slotted connection 116 and into the threaded outer extensions 134, 138 of the first and second receivers 132, 134. This secures the latch 125 into the slot connection 116. A portion of each shaft 150 extends out from the first and second receivers 132, 134 and through the slot. These portions of the threaded shafts 150 are smaller than the slot and engagement openings 118 so that they may travel freely along the entire length of the slotted connection 116. The engagement members 148 include outer button portions 149 that are larger than the slot and the engagement openings 118 and prevent the engagement members 148 from being pushed through the slotted connection 116.

When the helical spring 144 is in an uncompressed (or nearly uncompressed) position, the receivers 132, 136 are pushed outwards away from one another. This is a "locked" position because, in this configuration, the extensions 134, 138 automatically engage an engagement opening 118 when the latch 125 slides into alignment with the engagement opening. Since the extensions 134, 138 are larger than slot portion, the latch 125 is locked into this position and cannot travel along the slotted connection 116 once it is locked into place. Squeezing the button portions 149 of the engagement members 148 inward causes the helical spring 144 to be compressed and the first and second receivers 132, 136 to be pushed inwards so that the extensions 134, 138 no longer engage the engagement openings 118. In this condition, the threaded shafts 150 may travel freely along the slot and allow the latch 125 to freely translate along the slotted connection 116. This is the "unlocked" position. If pressure is removed from the button portions 149 of the engagement members 148, the latch 125 will continue to travel along the slotted connection 116 until the extensions 134, 138 encounter another pair of engagement openings 118 and move into the locked position due to the bias provided by the helical spring 144.

In use, the second end of the arm 126 translates along the slotted connection 116 while the first end of the arm pivots at the extensions connected to the upright member 120. At the same time, the tabletop support 104 pivots at the pivot connection 114. In combination, the movement allows the tabletop support 104 and, therefore, the tabletop 102, to move between horizontal and vertical positions. It may be appreciated that engagement openings 118 may be placed at various locations along the slot portion of the slotted connection 116 so that the tabletop 102 may be locked into a variety of orientations, including substantially vertical, substantially horizontal and one or more intermediate orientations.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An adjustable tray table comprising:

a tabletop;

a tabletop support connected to the tabletop, the tabletop support comprising:

a pivot connection; and at least one slotted connection comprising a slot and a plurality of spaced-apart engagement openings disposed along the slot; and a base assembly attached to the tabletop support and configured to allow the tabletop to move from a substantially vertical orientation to a substantially horizontal orientation, the base assembly comprising:

an upright member having a lower portion supported above a floor surface and an upper portion pivotally connected to the pivot connection of the tabletop support;

an arm having a first end pivotally connected to the upper portion of the upright member and a second end slidably engaged with the at least one slotted connection of the tabletop support; and a spring-biased squeezable latch attached to the second end of the arm, the latch having a squeezed position and a released position, the latch having at least one engagement member configured to selectively engage a first engagement opening of the plurality of engagement openings of the at least one slotted connection when the latch is aligned with the first engagement opening and is in the released position, the latch thereby fixing the tabletop support in a first desired orientation corresponding to the first engagement opening, the at least one engagement member configured to disengage from the first engagement opening and slide along the slot to a second engagement opening of the plurality of engagement openings of the at least one slotted connection when the latch is in the squeezed position, the at least one engagement member configured to engage the second engagement opening when the latch is aligned with the second engagement opening and is in the released position, the latch thereby fixing the tabletop support in a second desired orientation corresponding to the second engagement opening.

2. The adjustable tray table of claim 1 wherein the tabletop support comprises:

parallel first and second outer support members spaced apart from one another and attached to the bottom surface of the tabletop; and parallel first and second inner support members spaced apart from one another and attached to and between the first and second outer support members.

3. The adjustable tray table of claim 2 wherein the outer support members are orthogonal to the inner support members.

4. The adjustable tray table of claim 1 wherein the tabletop is formed by blow molding.

5. The adjustable tray table of claim 1 wherein the latch comprises:

a latch cylinder disposed adjacent the slotted connection;

the at least one engagement member comprising first and second engagement members disposed inside of the latch cylinder and configured to engage the slotted connection; and a spring disposed between the first and second engagement members.

6. The adjustable tray table of claim 5 wherein each engagement member comprises a shaft that passes through a slot of the slotted connection and a button portion attached to the shaft outside of the slotted connection.

7. The adjustable tray table of claim 6 wherein the button portion is larger than the engagement openings so that the button portion is precluded from passing through the engagement openings.

8. The adjustable tray table of claim 5 wherein each engagement member comprises an outward-facing threaded opening and wherein the shafts are threaded and are configured to engage the threaded opening.

9. The adjustable tray table of claim 5 wherein the spring is a helical spring.

10. The adjustable tray table of claim 1 wherein the base assembly may be adjusted to raise and lower the tabletop.

11. An adjustable tray table comprising:

a tabletop having a top surface and a bottom surface;

an H-shaped tabletop support having:

parallel first and second outer support members spaced apart from one another and attached to the bottom surface of the tabletop;

parallel first and second inner support members spaced apart from one another and disposed between and orthogonal to the first and second outer support members, each of the first and second inner support members having:

a pivot connection; and a slotted connection comprising a slot having a slot width and a plurality of circular engagement openings that are spaced-apart along the slot, each engagement opening having an inner diameter that is larger than the slot width; and a base assembly attached to the tabletop support and configured to allow the tabletop to move from a substantially vertical orientation to a substantially horizontal orientation, the base assembly comprising:

an upright member having a lower portion supported above a floor surface and an upper portion pivotally connected to the pivot connection of the tabletop support;

an arm having a first end and a second end, the first end pivotally connected to the upper portion of the upright member;

a latch assembly connected to the second end of the arm, the latch assembly comprising:

a latch cylinder disposed between the first and second inner support members and configured to slide along the slotted connections;

a first receiver disposed within the latch cylinder adjacent the first inner support member, the first receiver comprising;

a first cylindrical extension portion having an outer diameter that is smaller than the inner diameter of the engagement openings and larger than the slot width in the slotted connection of the first inner support member, the first cylindrical extension having an outward-facing threaded opening; and an opening facing inwards in a direction opposite from the first cylindrical extension a second receiver disposed within the latch cylinder adjacent the second inner support member, the second receiver comprising:

a second cylindrical extension portion having an outer diameter that is smaller than the inner diameter of the engagement openings and larger than the slot width in the slotted connection of the second inner support member, the second cylindrical extension having an outward-facing threaded opening;

an elongate post extending inwards in a direction opposite from the second cylindrical extension;

a helical spring disposed within the latch cylinder and around the elongate post, the helical spring having a first end pressing against the first receiver and a second end pressing against the second receiver, the helical spring thereby urging the first and second receivers in an outward direction away from the latch cylinder and toward the first and second inner support members;

a first engagement member comprising:

a first shaft passing through the slot of the slotted connection of the first inner support member, the first shaft having threads that engage the outward-facing threaded opening of the first cylindrical extension portion of the first receiver to connect the first engagement member to the first receiver, the first shaft having an outer diameter that is less than the slot width of the slotted connection so that the first shaft may slide freely within the slot; and a first button portion connected to the first shaft and disposed outside the first inner support member, the first button portion being larger than the engagement openings of the slotted connection of the first inner support member so that the first button portion is precluded from passing through the engagement openings;

a second engagement member comprising:

a second shaft passing through the slot of the slotted connection of the second inner support member, the second shaft having threads that engage the outward-facing threaded opening of the second cylindrical extension portion of the second receiver to connect the second engagement member to the second receiver, the second shaft having an outer diameter that is less than the slot width of the slotted connection so that the second shaft may slide freely within the slot; and a second button portion connected to the second shaft and disposed outside the second inner support member, the second button portion being larger than the engagement openings of the slotted connection of the second inner support member so that the second button portion is precluded from passing through the engagement openings, wherein when an external squeezing force is applied to the first and second button portions of the first and second engagement members to urge the first and second receivers inwardly toward each other, the first and second cylindrical extension portions of the first and second receivers slide inwardly and disengage from the engagement openings of the slotted connections of the first and second inner support members, thereby allowing the first and second shafts of the first and second engagement members to slide freely within the slots of the slotted connections, thereby allowing the latch assembly to move with respect to the first and second inner support members to change the orientation of the tabletop with respect to the base assembly, and wherein when the external squeezing force is removed from the first and second button portions of the first and second engagement members, thereby allowing the helical spring to urge the first and second receivers outwardly away each other, the first and second cylindrical extension portions of the first and second receivers slide outwardly and are received into the engagement openings of the slotted connections of the first and second inner support members, thereby locking the latch assembly in place with respect to the first and second inner support members and fixing the orientation of the tabletop with respect to the base assembly.

* * * * *